United States Patent [19]

Fujiwhara et al.

[11] 4,203,767

[45] May 20, 1980

[54] AMPLIFICATION PROCESS FOR LIGHT-SENSITIVE COLOR PHOTOGRAPHIC MATERIAL

[75] Inventors: Mitsuto Fujiwhara; Syunji Matsuo; Yutaka Kaneko; Toyoaki Masukawa; Mikio Kawasaki, all of Hino, Japan

[73] Assignee: Konishiroku Photo Industry Co., Ltd., Nihonbashi-Muro-machi, Japan

[21] Appl. No.: 849,983

[22] Filed: Nov. 9, 1977

Related U.S. Application Data

[63] Continuation of Ser. No. 640,268, Dec. 12, 1975, abandoned.

[30] Foreign Application Priority Data

Dec. 16, 1974 [JP] Japan ..... 48144615

[51] Int. Cl.[2] ..... G03C 7/00

[52] U.S. Cl. ..... 430/376; 430/566

[58] Field of Search ..... 96/55, 94, 109, 73, 96/84 R, 82, 49 R, 59, 95

[56] References Cited

U.S. PATENT DOCUMENTS

| | | | |
|---|---|---|---|
| 3,499,762 | 3/1970 | Cressman et al. | 96/82 |
| 3,594,171 | 7/1971 | Kimura et al. | 96/84 R |
| 3,674,490 | 7/1972 | Matejec | 96/49 R |
| 3,776,730 | 12/1973 | Matejec et al. | 96/59 |

OTHER PUBLICATIONS

Photographic Processing Chemistry, Mason, Focal Press, N.Y. 1962, pp. 254–260.

*Primary Examiner*—J. Travis Brown

*Attorney, Agent, or Firm*—Haseltine, Lake & Waters

[57] ABSTRACT

In a process for providing a color image which comprises imagewise exposing a multilayered light-sensitive photographic material comprising a support and a light-sensitive silver halide emulsion layer not having a coupler incorporated therein and thereafter developing said exposed photographic material with a coupler-containing color developer, the speed and color density of the image are improved by incorporating into the light-sensitive silver halide emulsion layer or the layer contiguous therewith oil particles of a high boiling solvent such as phthalate, phosphate, amide and alcohol type solvents.

4 Claims, No Drawings

AMPLIFICATION PROCESS FOR LIGHT-SENSITIVE COLOR PHOTOGRAPHIC MATERIAL

This is a continuation of application Ser. No. 640,268 filed Dec. 12, 1975, now abandoned.

This invention relates to a light-sensitive color photographic material for the production of a natural color or pseudocolor photograph.

Generally, substractive light-sensitive color photographic processes are classified two types: one is a process using color photographic materials in which color couplers are incorporated in the silver halide emulsion layers, and the other is a process in which color couplers are contained in the color developers, like the Kodachrome process. While most of the recent light-sensitive color photographic materials are operative with the former type process, the latter type process is adopted for such photographic materials as 8 mm. color photographic films and 35 mm. color photographic reversal films which are required to be more excellent in graininess. The present invention is concerned with an improvement of a light-sensitive color photographic material used for the Kodachrome process, and the resulting color image includes natural color photographic images and pseudocolor images bearing records of images of such radiations as X-rays, infrared rays, gamma rays, etc.

For the enhancement in speed of a Kodachrome process type light-sensitive color photographic material and for the increase in density of the color image, there has heretofore been adopted the procedure that the speed of the silver halide emulsion layer is increased, the content of the silver halide is increased, or the pH of the developer is increased. This procedure, however, has the fatal disadvantages that the light-sensitive color photographic material is markedly deteriorated in storability or is difficultly developed under constant conditions, with the result that the finished photographic materials are greatly disuniform in quality from one lot to another.

An object of the present invention is to provide a high speed light-sensitive color photographic material of the Kodachrome process type, capable of giving a high density color image which is free from such disadvantages as mentioned above.

We have found that the above-mentioned object can be accomplished by incorporating oil particles of a high boiling solvent into the silver halide emulsion layer, or the layer contiguous thereto, of a Kodachrome process type light-sensitive color photographic material.

That is, when oil particles of a high boiling solvent are incorporated into the silver halide emulsion layer or the layer contiguous thereto, the developing agent and couplers in the color developer become easily penetrable into the silver halide emulsion layer, since the oil particles tend to absorb the said developing agent and couplers, with the result that the color development is more accelerated. When the acceleration ratio is more than 20% as compared with the case where no oil particles of high boiling solvent are incorporated, the speed of the photographic material and the density of the resulting image are expected to increase several times. The effect of incorporation of the oil particles becomes more marked particularly in the case of a light-sensitive color photographic material prepared by using a silver halide emulsion having a low content of silver.

The high boiling solvent used in the present invention to form oil particles is preferably a colorless and transparent organic solvent having a boiling point of at least 180° C. Examples of such organic solvents are phthalates such as dimethyl phthalate, diethyl phthalate, dibutyl phthalate, dioctyl phthalate or dibenzyl phthalate; phosphates such as triphenyl phosphate, tricresyl phosphate, tri-o-tolyl phosphate, tri-p-tolyl phosphate or tri-m-tolyl phosphate; esters such as hexyl stearate, dodecyl laurate, dibutyl adipate or dibutyl sebacate; amides such as diethyl lauramide or dibutyl lauramide; and alcohols such as octadecyl alcohol, isostearyl alcohol or phenoxyethyl alcohol.

For forming the oil particles of such a high boiling solvent, there may be adopted such procedure that the aforesaid high boiling organic solvent is emulsified and dispersed in an aqueous gelatin solution or a silver halide emulsion by means of a emulsifying and dispersing machine, such as a colloid mill or a homogenizing blender, in the presence of a surfactant such as Alkanol-W-XC produced by DuPont Co. or Newlex C-1 produced by Nissan Yushi Co. The amount of the high boiling solvent to be added to said aqueous gelatin solution or silver halide emulsion is in the range from 0.5 ml. to 1,000 ml., preferably from 5 ml. to 500 ml., per kg. of gelatin. The resulting dispersion may be incorporated with photographic additives such as inhibitor, sensitizer, ultraviolet absorber and coating aid, a developer, a higher fatty acid which is a dispersion aid for the high boiling solvent, or $\alpha$-(2,4-di-t-pentyl)-phenoxybutyric acid and the like compounds which are ordinarily used as oleophilic groups of couplers for coupler-incorporated type light-sensitive color photographic materials. The silver halide emulsion layer, into which such high boiling solvent is to be dispersed, is the emulsion layer of a known mono- or multi-layered light-sensitive color photographic material, or the emulsion layer of a light-sensitive silver halide pseudocolor photographic material to record images of such radiation as X-rays, infrared rays, gamma rays, etc.

The above-mentioned emulsion layer can contain a methine or styryl type sensitizing dye such as cyanine, merocyanine, hemicyanine, rhodacyanine, oxonol or hemioxonol, a reduction sensitizer, a noble metal sensitizer, a sulfur sensitizer, a selenium sensitizer or an active gelatin sensitizer, an azole type, mercapto type or ester type inhibitor, and the like photographic additives except dye forming couplers.

The emulsion usable in the present invention may be any emulsion containing silver chloride, silver bromide silver chlorobromide, silver iodide, silver iodobromide or silver chloroiodobromide. The content of silver halide in said emulsion is in the range from 0.05 to 200 mg. in terms of silver per 100 $cm^2$, and the effect is greater particularly when the amount of silver is in such a low range as from 0.2 to 20 mg.

The silver halide emulsion layer containing the oil particles of the high boiling solvent may be coated, according to an ordinary procedure, on a support such as a polyester, polyethylene or cellulose acetate film, a baryta paper, a resin coated paper or a glass plate, or a gelatin protective layer containing the said oil particles may be coated on an emulsion layer containing no oil particles of high boiling solvent. Alternatively, the oil particles of the high boiling solvent used in the present invention may be incorporated into any layer of a light-sensitive silver halide photographic material, but the effect is greater when the oil particles are incorporated into the upper emulsion layer of the photographic material.

In the case where a color image is formed by incorporating the high boiling solvent used in the present invention into the emulsion or protective layer of a light-sensitive silver halide photographic material, and then subjecting the photographic material to development with a coupler-containing color developer, to bleach-fixing with a bleach-fixer and to water-washing, the high boiling solvent contributes to the improvement in such photographic properties as speed, gamma and maximum density ($D_{max}$). However, particularly when the said photographic material is subjected to amplification by treatment with such agents as peroxides or cobalt hexammine trichloride, the presence of the high boiling solvent makes it possible to bring about marked effects on the improvement in such photographic properties as speed, gamma and maximum density. Particularly when such low silver content photographic material as Sample No. 2 or Sample No. 4 prepared in Example 1 shown later is developed with a color developer, processed with an amplifying agent such as peroxides or cobalt complexes, e.g. cobalt hexammine trichloride, and then subjected to bleach-fixing and water-washing, the aforesaid photographic properties can be greatly improved.

The reason why the photographic properties can thus be improved by incorporating a high boiling solvent into the silver halide emulsion layer or protective layer of a photographic material is considered ascribable to the fact that the solvent makes the color developing agent and couplers in the developer penetrate more favorably into the silver halide photosensitive layer to accelerate the color development action, and is further considered ascribable to the fact that in the processing step for amplifying the density of the color image by treatment with an amplifying agent such as hydrogen peroxide, the high boiling solvent accelerates the action of said amplifying agent.

As the couplers to be used in the color developer, there may be used known couplers such as, for example, a phenol or naphthol type cyan coupler, a cumarone, pyrazolinobenzimidazole, pyrazolone, indazolone, or cyanoacetyl type magenta coupler, and an open-chain active methylene type yellow coupler. Further, as the color developing agent, there may be used a known p-phenylenediamine type compound. When these couplers and color developing agents are used in proper combination according to the desired purpose, it is possible to obtain a natural color image, a monochromatic image or a black-and-white color image.

The present invention is illustrated in detail below with reference to examples, but the scope of the invention is not limited to the examples.

EXAMPLE 1

On a cellulose triacetate base, a silver bromide emulsion for color paper having a gelatin:silver ratio of 17:4 was coated so that the amount of coated silver became 2.3 mg/100 cm$^2$. On the resulting emulsion layer, a gelatin protective film containing a hardener and a surfactant was provided to prepare a control sample (Sample No. 1). Separately, a control sample (Sample No. 2) was prepared in the same manner as in the case of Sample No. 1, except that the gelatin:silver ratio was varied to 17:0.4. Further, samples (Sample Nos. 3 and 4) were prepared in the same manner as in the cases of the control samples (Sample Nos. 1 and 2), except that dibutyl phthalate was incorporated into the emulsion in an amount of about 1 mg/100 cm$^2$.

Each of the thus prepared samples and control samples was exposed through a wedge, subjected to color development at 20° C. for 10 minutes using the prescription shown below, and then bleached, fixed, water-washed and dried.

| Color developer: | |
|---|---|
| (Solution A) | |
| p-(N,N-Diethylamino)-aniline hydrochloride | 3 g. |
| Anhydrous sodium sulfite | 10 g. |
| Anhydrous potassium carbonate | 20 g. |
| Potassium bromide | 3 g. |
| Water to make | 1 liter |
| Adjusted to pH 10. | |
| (Solution B) | |
| p-Cyanoacetyl acetanilide | 3 g. |
| Ethyl alcohol | 100 ml. |

The solutions A and B were mixed together immediately before use.

Separately, the samples (Sample Nos. 3 and 4) after the above-mentioned color development were individually processed at 20° C. for 10 minutes with a hydrogen peroxide amplifying solution of the composition shown below, and then bleached, fixed, water-washed and dried.

| Hydrogen peroxide samplifying solution | |
|---|---|
| 35% Aqueous hydrogen peroxide solution | 25 ml. |
| Water to make | 1 liter |

Adjusted to pH 8.0 with a 1N-sodium hydroxide solution.

The photographic properties of the thus processed samples and control samples were as shown in Table 1.

TABLE 1

| Sample No. | Photographic properties | High boiling solvent | Amplifying agent | Relative speed | Gamma | $D_{max}$ | Fog |
|---|---|---|---|---|---|---|---|
| Control | 1 | — | — | 100 | 2.8 | 1.5 | 0.03 |
| Sample | 2 | — | — | Immeasurable | Immeasurable | 0.3 | 0.01 |
| Sample | 3 | Dibutyl pathalate 1 mg/100 cm$^2$ | — | 115 | 3.1 | 2.0 | 0.03 |
| | " | Dibutyl pathalate 1 mg/100 cm$^2$ | $H_2O_2$ | 130 | 4.2 | 2.9 | 0.04 |
| | 4 | Dibutyl pathalate 1 mg/100 cm$^2$ | — | Immeasurable | Immeasurable | 0.4 | 0.01 |

TABLE 1-continued

| Sample No. | Photographic properties | High boiling solvent | Amplifying agent | Relative speed | Gamma | $D_{max}$ | Fog |
|---|---|---|---|---|---|---|---|
| | " | Dibutyl pathalate 1 mg/100 cm$^2$ | $H_2O_2$ | 120 | 3.9 | 2.5 | 0.03 |

The relative speed is a value measured by assuming that the speed of the control sample (Sample No. 1) was 100. Further, $D_{max}$ is the maximum density of the developed magenta color.

From Table 1, it is understood that when oil particles of a high boiling solvent are incorporated into the emulsion layer of a light-sensitive photographic material, the photographic material is greatly improved in speed, gamma and $D_{max}$, and that particularly when the photographic material is subjected to amplification treatment with hydrogen peroxide, the presence of oil particles of a high boiling solvent greatly enhances the amplifying effect of hydrogen peroxide.

EXAMPLE 2

On a polyethylene terephthalate base, a silver halide emulsion for lith-type light-sensitive material having a gelatin:silver ratio of 1:0.4 (the said proportion of silver being about ¼ to 1/6 the proportion of silver in an ordinary emulsion for lith-type light-sensitive material) was coated so that the amount of coated silver was 10 mg/100 cm$^2$. On the resulting emulsion layer, a gelatin protective layer containing a hardener and a surfactant was provided to prepare a control sample. Separately, a sample was prepared in the same manner as in the case of the control sample, except that a high boiling solvent tricresyl phosphate was incorporated into the emulsion in an amount of 1 mg/100 cm$^2$.

Each of the thus prepared sample and control sample was exposed through a halftone negative, and then developed at 20° C. for 2 minutes and 30 seconds with a lith-type developer of the composition shown below.

| Lith-type developer: | |
|---|---|
| Hydroquinone | 15.0 g. |
| Formaldehyde-sodium bisulfite | 60.0 g. |
| Sodium sulfite | 2.5 g. |
| Boric acid | 4.0 g. |
| Diethylene glycol | 40.0 g. |
| Potassium bromide | 0.5 g. |
| Water to make | 1 liter |

Adjusted to pH 9.85 with sodium carbonate monohydrate.

After fixing, each sample was developed in the light at 20° C. for 1 minute with a magenta color developer of the composition shown below.

| Magenta color developer | |
|---|---|
| (Solution A) | |
| 2-Methyl-4-(N,N-diethylamino)-aniline hydrochloride | 10 g. |
| Sodium sulfite | 10 g. |
| Sodium carbonate monohydrate | 30 g. |
| Sodium hydroxide | 2 g. |
| Water to make | 1 liter |
| Adjusted to pH 10.5 | |
| (Solution B) | |
| 1-Phenyl-3-aminopyrazoline-5-one | 2 g. |

-continued

| Magenta color developer | |
|---|---|
| Ethyl alcohol | 100 ml. |

The solutions A and B were mixed together immediately before use.

Subsequently, the developed sample was processed at 20°C. for 6 minutes with an amplifying solution prepared by dissolving 30 g. of sodium peroxoborate ($NaBO_3.4H_2O$) in water to make the whole amount 1 liter, and adjusting the resulting solution to pH 8.0 with a 1N aqueous sodium hydroxide solution. After processing with the abovementioned amplifying solution, each sample was sufficiently washed with water and then dried.

As the result, both the sample and the control sample gave low density and obscure dot images when subjected to only the processing with the lith-type developer. When processed with the amplifying solution, however, only the sample containing the high boiling solvent was amplified to form a high density and brilliant magenta colored dot image.

EXAMPLE 3

On a polyester film base, a silver halide emulsion for X-ray light-sensitive material having a gelatin:silver ratio of 20:1 (the said proportion of silver being about 1/10 to 1/20 the proportion of silver in an ordinary emulsion for X-ray light-sensitive material) was coated so that the amount of coated silver became 5 mg/100 cm$^2$. On the resulting emulsion layer, a gelatin protective layer was provided to prepare a control sample (Sample No. 5). Separately, a sample (Sample No. 6) was prepared in the same manner as in the case of the control sample, except that a mixed solution comprising 1 part of a high boiling solvent dibutyl phthalate and 1 part of α-(2,4-di-t-amylphenoxy) putyric acid was incorporated into the emulsion in such an amount as to become 1 mg/100 cm$^2$.

Each of the thus prepared sample and control sample was exposed through a wedge, and then developed at 20° C. for 4 minutes with a cyan color developer of the composition shown below.

| Cyan color developer: | |
|---|---|
| (Solution A) | |
| 2-Methyl-4-(N,N-diethylamino)-aniline hydrochloride | 4 g. |
| Sodium sulfite | 10 g. |
| Potassium carbonate | 20 g. |
| N-Methylbenzothiazolium-p-toluenesulfonate | 1 g. |
| Water to make | 1 liter |
| Adjusted to pH 10.0 with sodium hydroxide. | |
| (Solution B) | |
| 4-Methoxy-αnaphthol | 3 g. |
| Ethyl alcohol | 100 ml. |

The solutions A and B were mixed together immediately before use.

Subsequently, the sample and the control sample were processed at 20° C. for 5 minutes with an amplifying solution of the composition shown below.

| Hydrogen peroxide samplifying solution | |
|---|---|
| 35% Aqueous hydrogen peroxide solution | 25 ml. |
| Water to make | 1 liter |

Adjusted to pH 8.0 with 1N-sodium hydroxide.

Thereafter, each sample was fixed with a fixing bath. Separately, each sample was processed with a bleachfixing bath in place of the fixing bath. The photographic properties of the thus processed sample and control sample were as shown in Table 2.

Table 2

| Sample No. | Procesing | $D_{max}$ |
|---|---|---|
| Control Sample 5 | Fixing only | 0.8 |
| Control Sample 5 | Bleach-fixing | 0.6 |
| Sample 6 | fixing only | 3.5 |
| Sample 6 | Bleach-fixing | 3.0 |

From Table 2, it is understood that the sample containing the high boiling solvent is far more excellent in color development efficiency.

EXAMPLE 4

Each of the sample (Sample No. 6) and the control sample (Sample No. 5) prepared in Example 3 was exposed through a wedge, and then developed at 30° C. for 3 minutes with a black-white developer of the composition shown below.

| Black-white developer: | |
|---|---|
| Hydroquinone | 2.0 g. |
| phenidone (1-phenyl-3-pyrazolidone) | 0.3 g. |
| Potassium carbonate | 20.0 g. |
| N-Methylbenzothiazolium-p-toluenesulfonate | 1.0 g. |
| Water to make | 1 liter |

Adjusted to pH 11.0 with an aqueous sodium hydroxide solution.

The developed sample was fixed and water-washed. In this case, both the sample and the control sample gave such faint silver images as to be scarcely visible. Thereafter, each sample was developed in daylight at 30° C. for 27 minutes with a cyan color developer of the composition shown below.

| Cyan color developer: | |
|---|---|
| (Solution A) | |
| 2-Methyl-4-(N-ethyl-N-3-methanesulfonamidoethyl)-aniline sulfate | 4.4 g. |
| Sodium bisulfite | 10.0 g. |
| Potassium carbonate | 20.0 g. |
| Water to make | 1 liter |
| Adjusted to pH 10.0 with an aqueous sodium hydroxide solution. | |
| (Solution B) | |
| α-Naphthol | 4.0 g. |
| Ethyl alcohol | 30 ml. |

The solutions A and B were mixed together immediately before use.

Subsequently, each sample was processed with the same hydrogen peroxide amplifying solution as in Example 3. As the result, the sample containing the high boiling solvent gave a high density cyan image as shown in Table 3.

Table 3

| Kind of sample | $D_{max}$ |
|---|---|
| Control sample | 0.9 |
| Sample | 2.5 |

EXAMPLE 5

Each of the sample (Sample No. 6) and the control sample (Sample No. 5) prepared in Example 3 was exposed through a wedge, and then developed at 30° C. for 3 minutes with a developer of the composition shown below.

| Developer: | |
|---|---|
| 2-Methyl-4-(N,N-diethylamino)-aniline hydrochloride | 4 g. |
| Sodium sulfite | 10 g. |
| Potassium carbonate | 20 g. |
| N-Methylbenzothiazolium-p-toluenesulfonate | 1 g. |
| Water to make | 1 liter |

Adjusted to pH 11.0 with sodium hydroxide.

Subsequently, the developed sample was processed at 30° C. for 3 minutes with the same hydrogen peroxide amplifying solution as in Example 3, and then subjected to fixing, water-washing and drying. As the result, the control sample containing no high boiling solvent gave no color image, whereas the sample containing the high boiling solvent gave a deep dark yellowish brown imagewise color image derived from autocoupling of the color developer.

EXAMPLE 6

Each of the sample (Sample No. 6) and the control sample (Sample No. 5) prepared in Example 3 was exposed and then developed at 30° C. for 3 minutes with an external type color developer of the composition shown below.

| Color developer: | |
|---|---|
| (Solution A) | |
| 2-Methyl-4-(N,N-diethylamino)-aniline hydrochloride | 4 g. |
| Sodium sulfite | 10 g. |
| Potassium carbonate | 20 g. |
| N-Methylbenzothiazolium-p-toluenesulfonate | 1 g. |
| 1-Phenyl-5-mercaptotetrazole | 5 mg. |
| Water to make | 1 liter |
| Adjusted to pH 11.0 with sodium hydroxide. | |
| (Solution B) | |
| 2-Amino-4-chloro-5-methyl-6-chlorophenol | 3 g. |
| 1-Phenyl-3-methylpyrazolone | 3 g. |
| α-(β-Carboxypropionyl)acetanilide | 1 g. |
| Ethyl alcohol | 100 ml. |

The solutions A and B were mixed together immediately before use.

Subsequently, the developed sample was processed at 30° C. for 3 minutes with the same hydrogen peroxide amplifying solution as in Example 3, and then subjected to fixing, water-wasing and drying.

As the result, both the sample and the control sample gave imagewise color images, but the sample containing the high boiling solvent gave a black color image far higher in density than in the case of the control sample containing no high boiling solvent, as shown in Table 4.

Table 4

| Kind of sample | $D_{max}$ |
|---|---|
| Control sample | 1.9 |
| Sample | 3.9 |

What is claimed is:

1. A process for providing a color image which process comprises imagewise exposing a multi-layered light-sensitive photographic material comprising a support and a light-sensitive silver halide emulsion layer not having a coupler incorporated therein and a layer contiguous therewith, said emulsion layer or the layer contiguous therewith containing oil particles of a high boiling solvent, and developing said exposed photographic material with a coupler-containing color developer and processing said developed photographic material with an amplifying solution.

2. The process according to claim 1 wherein said lightsensitive photographic material contains 0.02 to 20 mg of silver per 100 $cm^2$ of said silver halide emulsion layer.

3. The process according to claim 1 wherein said amplifying solution contains hydrogen peroxide.

4. The process according to claim 1 wherein said contiguous layer is above the silver halide emulsion layer.

* * * * *